US005579255A

United States Patent [19]

Sakata

[11] Patent Number: 5,579,255

[45] Date of Patent: Nov. 26, 1996

[54] ANALOG ARITHMETIC CIRCUIT WITH ELECTRIC RESISTOR NETWORKS AND NUMERICAL SOLUTION METHOD OF FOURTH-ORDER PARTIAL DIFFERENTIAL EQUATION BY THE USE OF THE CIRCUIT

[75] Inventor: Fumio Sakata, Tokyo, Japan

[73] Assignees: Sakata Denki Co., Ltd.; Radic Co., Ltd., both of Tokyo, Japan

[21] Appl. No.: 449,487

[22] Filed: May 24, 1995

[51] Int. Cl.[6] ..... G06G 7/38

[52] U.S. Cl. ..... 364/810

[58] Field of Search ..... 364/810, 808

[56] References Cited

U.S. PATENT DOCUMENTS

| | | | |
|---|---|---|---|
| 2,857,099 | 10/1958 | Liebmann | 364/810 |
| 2,884,193 | 4/1959 | Liebmann | 364/810 |
| 2,899,134 | 8/1959 | Rocard | 364/810 |
| 4,734,879 | 3/1988 | Lin et al. | 364/810 |

OTHER PUBLICATIONS

"The Method of Stress Analysis of Ground by Means of Electrical Resistance Network Method" by Sakata et al, in the 28th Japan National Conference on Soil Mechanics and Foundation Engineering, Kobe, Japan, Jun. 29th–Jul. 1st, 1993, E13, pp. 1501–1502.

*Primary Examiner*—Tan V. Mai

*Attorney, Agent, or Firm*—Hopgood, Calimafde, Kalil & Judlowe

[57] ABSTRACT

In order to carry out dynamic analysis of a phenomenon described by a fourth-order partial differential equation of a function, an analog arithmetic circuit includes a Poisson's circuit (11) and a Laplace's circuit (15). The Poisson's circuit (11) includes a resistor network, additional resistors (R) having one ends connected to nodes of the resistor network, respectively, and subtractor circuits (13) each of which is for subtracting a predetermined voltage from a node voltage at each node to produce an output voltage supplied to the other end of the additional resistor connected to each node. External and boundary voltages are applied to the resistor network. The Laplace's circuit (15) comprises a similar resistor network. Each of the nodes of the Laplace's circuit is connected to the corresponding one of the subtractor circuits to supply the predetermined voltage. Each of calculating circuits (17) connected to peripheral terminals of the Laplace's circuit calculates a voltage from the external and boundary voltages and the node voltage to produce a calculated voltage supplied to the peripheral terminals. Thus, the node voltages provide solutions of the function.

8 Claims, 5 Drawing Sheets

ANALOG ARITHMETIC CIRCUIT WITH ELECTRIC RESISTOR NETWORKS AND NUMERICAL SOLUTION METHOD OF FOURTH-ORDER PARTIAL DIFFERENTIAL EQUATION BY THE USE OF THE CIRCUIT

BACKGROUND OF THE INVENTION

This invention relates to electrical analog solution of partial differential equations describing phenomena and, in particular, to analog solution of fourth-order partial differential equations.

In order to carry out technological analysis of phenomena described by partial differential equations, the finite element method has been used by digital computer aid. It is known as a numerical solution method with considerably high precision. In the solution method, the computer is, however, required to be capable of a high speed arithmetic operation so as to perform dynamic analysis of phenomena.

As a numerical solution method adaptable for the high speed arithmetic operation, an analog solution method has been proposed in conjunction with the Laplace's equation and the Poisson's equations among various partial differential equations, in a paper entitled "The Method of Stress Analysis of Ground by Means of Electrical Resistance Network Method" by Sakata et al, in The 28th Japan National Conference on Soil Mechanics and Foundation Engineering, Kobe, Japan, Jun. 29th–Jul. 1st, 1993, E-13, pp. 1501–1502.

However, it is difficult to directly use the analog solution method for a high-order partial differential equation.

SUMMARY OF THE INVENTION

It is therefore an object of this invention to provide a high-speed arithmetic circuit capable of analog solution of a fourth-order partial differential equation so as to economically and accurately carry out dynamic analysis of a phenomenon described by a partial differential equation.

It is another object of this invention to provide a method of solving a fourth-order partial differential equation by the use of the above-mentioned high-speed arithmetic circuit.

According to an aspect of this invention, there is provided an analog arithmetic circuit for solving a fourth-order partial differential equation of a function comprising: a first resistor network comprising a plurality of first resistors connected to each other in a form of a lattice structure to have a plurality of first interconnected points arranged in a matrix form and a plurality of additional resistors having one ends connected to the first interconnected points, respectively, the first resistor network having a plurality of first peripheral terminals at outer ends of outermost ones of the first resistors, the first peripheral terminals being supplied with external point voltages of first predetermined voltage levels, respectively, outermost ones of the first interconnected points being supplied with boundary voltages of second predetermined voltage levels, first resultant voltages being present at the remaining ones of the first interconnected points excluding the outermost first interconnected points; a plurality of subtracting means connected to the remaining first interconnected points, respectively, for subtracting second resultant voltages from the first resultant voltages to produce subtracted voltages, the subtracted voltages being supplied to the other ends of the additional resistors, respectively; a second resistor network comprising a plurality of second resistors connected to each other in a form of a lattice structure to have a plurality of second interconnected points arranged in a matrix form and corresponding to the remaining first interconnected points, respectively, the second resistor network having a plurality of second peripheral terminals at outer ends of outermost ones of the second resistors, the second peripheral terminals corresponding to the first peripheral terminals, respectively, the second resultant voltages being present at the second interconnected points and being supplied therefrom to the subtracting means, respectively; and a plurality of calculating means connected to the second peripheral terminals, respectively, each of the calculating means calculating a total voltage of one of the external point voltages supplied to a corresponding one of the first peripheral terminals, two of the boundary voltages supplied to two adjacent to the corresponding one of the outermost first interconnected points, and one of the first resultant voltages on the adjacent one of the remaining ones of the first interconnected points adjacent to the corresponding one of the outermost first interconnected points, and subtracting four times of one of the boundary voltages supplied to the corresponding one of the outermost first interconnected points from the total voltage to produce a calculated voltage, the calculated voltage being supplied to the corresponding one of the second external terminals, whereby the first resultant voltages provide solutions of the function of the fourth-order partial differential equation.

According to another aspect of this invention, there is provided a method of solving a fourth-order partial differential equation of a function by the use of an analog arithmetic circuit comprising: a first resistor network comprising a plurality of first resistors connected to each other in a form of a lattice structure to have a plurality of first interconnected points arranged in a matrix form and a plurality of additional resistors having one ends connected to the first interconnected points, respectively, the first resistor network having a plurality of first peripheral terminals at outer ends of outermost ones of the first resistors, the first interconnected points classified into outermost ones and the remaining ones; a plurality of subtracting means having first input terminals connected to the remaining first interconnected points, respectively, second input terminals, and output terminals connected to the other ends of the additional resistors, respectively; a second resistor network comprising a plurality of second resistors connected to each other in a form of a lattice structure to have a plurality of second interconnected points arranged in a matrix form and corresponding to the remaining first interconnected points, respectively, the second resistor network having a plurality of second peripheral terminals at outer ends of outermost ones of the second resistors, the second peripheral terminals corresponding to the first peripheral terminals, respectively, the second interconnected points being connected to the second input terminals of the subtracting means, respectively; a plurality of calculating means connected to the second peripheral terminals, respectively; the method comprising the steps of: supplying external voltages of first predetermined voltage levels to the first terminals and the calculating means, respectively, first resultant voltages being present at the remaining first interconnected points; supplying boundary voltages of second predetermined voltage levels to the outermost first interconnected points and the calculating points, each of the calculating means calculating a total voltage of one of the external point voltages supplied to a corresponding one of the first peripheral terminals, two of the boundary voltages supplied to two adjacent to the corresponding one of the outermost first interconnected points, and one of the first resultant voltages on the adjacent one of the remaining ones of the first interconnected points adjacent to the corresponding one of the outermost first interconnected points, and subtracting four times of one of the boundary voltages supplied to the corresponding one of the outermost first interconnected points from the total voltage to produce a calculated voltage, the calculated voltage being supplied to the corresponding one of the second external terminals, whereby second resultant voltages are present at the second interconnected points, the subtracting means subtracting the second resultant voltages from the first resultant voltages to produce subtracted voltages, the subtracted voltages being supplied to the other ends of the additional resistors, so that the first resultant voltages provide solutions of the function of the fourth-order partial differential equation.

DESCRIPTION OF THE PREFERRED EMBODIMENT

For a better understanding of this invention, description will at first be made as regards conventional analog solution methods.

The calculus of finite difference or the finite difference method is known as one of numerical solution methods of a differential equation. The calculus of finite difference comprises the steps of selecting a plurality of points on a continuous function of the differential equation at an appropriate interval, calculating differences between values of the function at every adjacent points to obtain derivatives of the continuous function, converting the differential equation into an algebraic equation comprising the derivatives, and solving the algebraic equation to obtain a solution.

Figure 1:
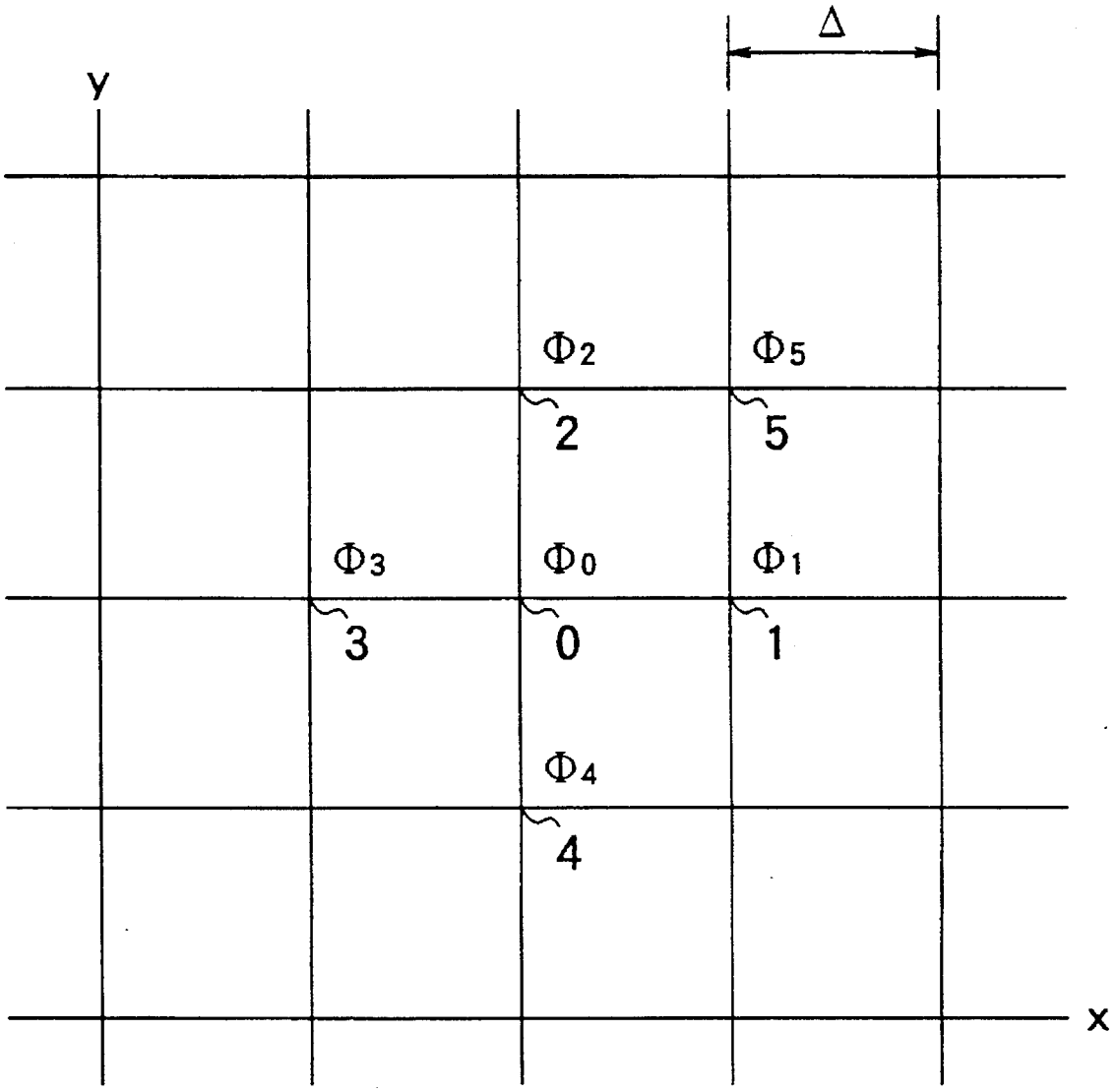
FIG. 1 PRIOR ART
FIG. 1 shows a coordinate system used in the finite difference method which is a known analog solution of a partial differential equation.

Referring to FIG. 1, a continuous function $\phi(x, y)$ on an x-y plane defined by an x axis and a y axis has an origin (0) arbitrarily selected. A group of straight lines extend in parallel to the x axis at an interval $\Delta$. Likewise, another group of straight lines extend in parallel to the y axis at the interval $\Delta$. These straight lines intersect with one another at a plurality of interconnected points or nodes. Among the nodes, four nodes most nearest to the origin (0) are represented by coordinates 1, 2, 3, and 4 sequentially in a counterclockwise direction with the coordinate 1 assigned to the one located at the right of the origin (0). Function values at the nodes 1, 2, 3, and 4 are represented by $\phi_n$ (n=1, 2, 3, 4).

In the coordinate system illustrated in the figure, a first-order differential and a second-order differential by the use of the function values $\phi_n$ (n=1, 2, 3, 4) at those coordinates are converted into difference equations as shown in Equations (1-1), (1-2), (1-3), and (1-4). The sum of Equations (1-3) and (1-4) gives Equation (2-1). The Laplace's equation represented by Equation (2-2) is transformed into a finite difference equation such as Equation (2-3).

$$\left(\frac{\partial\phi}{\partial x}\right)_0 = (\phi_1 - \phi_0)/\Delta \tag{1-1}$$

$$\left(\frac{\partial\phi}{\partial y}\right)_0 = (\phi_2 - \phi_0)/\Delta \tag{1-2}$$

$$\left(\frac{\partial^2\phi}{\partial x^2}\right)_0 = \{(\phi_1 - \phi_0) - (\phi_0 - \phi_3)\}/\Delta^2 = (\phi_1 - 2\phi_0 + \phi_3)/\Delta^2 \tag{1-3}$$

$$\left(\frac{\partial^2\phi}{\partial y^2}\right)_0 = \{(\phi_2 - \phi_0) - (\phi_0 - \phi_4)\}/\Delta^2 = (\phi_2 - 2\phi_0 + \phi_4)/\Delta^2 \tag{1-4}$$

$$\left(\frac{\partial^2\phi}{\partial x\partial y}\right)_0 = (\phi_0 - \phi_1 - \phi_2 + \phi_5)/\Delta^2 \tag{1-5}$$

$$\frac{\partial^2\phi}{\partial x^2} + \frac{\partial^2\phi}{\partial y^2} = (\phi_1 + \phi_2 + \phi_3 + \phi_4 - 4\phi_0)/\Delta^2 \tag{2-1}$$

$$\frac{\partial^2\phi}{\partial x^2} + \frac{\partial^2\phi}{\partial y^2} = 0 \tag{2-2}$$

$$\phi_1 + \phi_2 + \phi_3 + \phi_4 - 4\phi_0/\Delta^2 = 0 \tag{2-3}$$

According to the coordinate system used in the above-mentioned calculus of finite difference, a register network is formed which comprises electrical resistor elements connected to one another to form a lattice structure. It is possible to describe the relationship of resistances, voltages, and currents distributed on the resistor network by equations similar to those obtained by the calculus of finite difference.

Figure 2:
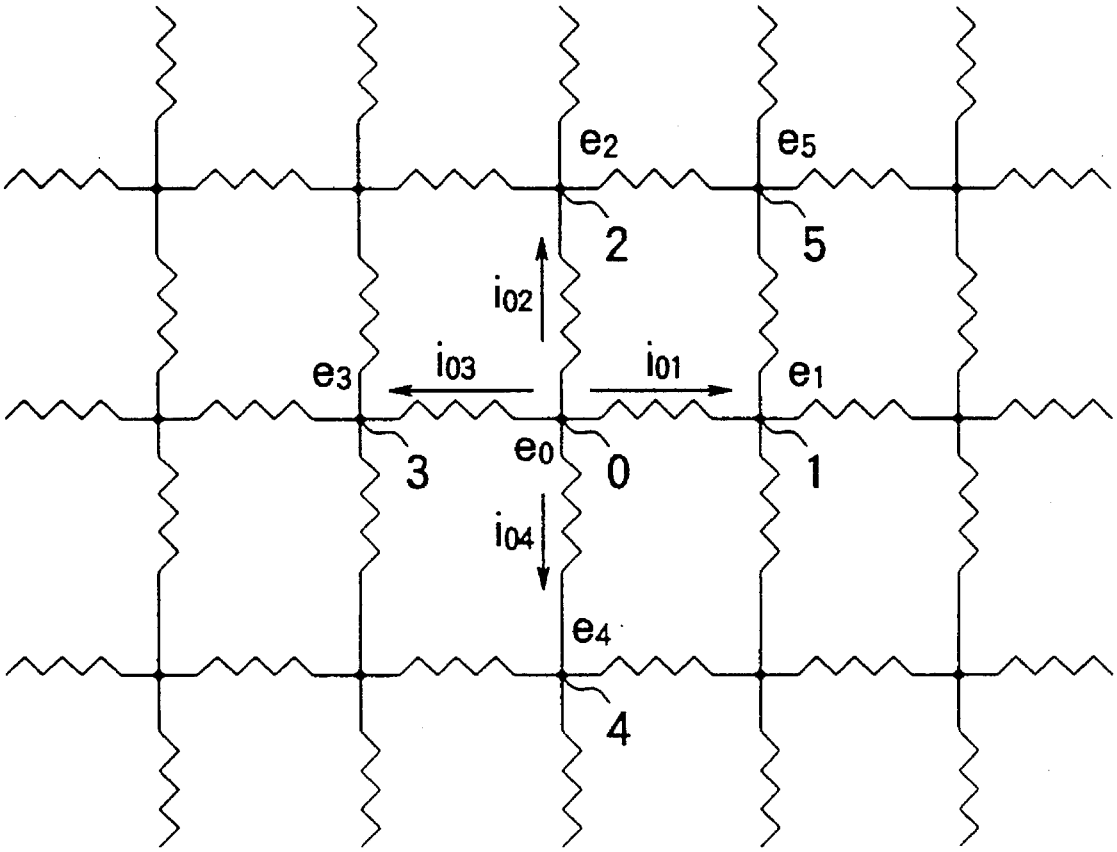
FIG. 2 PRIOR ART
FIG. 2 is a view for describing a conventional resistor network to solve the Laplace's equation in accordance with the analog solution.

Referring to FIG. 2, relationships of resistance R, voltage values ($e_0$, $e_1$, $e_2$, $e_3$, $e_4$), and current values ($i_{01}$, $i_{02}$, $i_{03}$, $i_{04}$) at the coordinates (0, 1, 2, 3, 4) are given by Equations (3-1), (3-2), (3-3), and (3-4) in accordance with the Ohm's law.

It is noted here that an algebraic total sum of the current flowing into and out of a particular node in the circuit is equal to zero according to the Kirchhoff's current law. Where, the out-flow current and in-flow current are represented with opposite signs opposite to each other. From this, the sum of Equations (3-1), (3-2), (3-3), and (3-4) gives Equation (4-1). When the continuous function $\phi$ in Equation (2-1) is replaced by a voltage function e, Equation (4-2) is obtained. Equation (4-2) indicates that the Laplace's equation is electrically realized on the resistor network illustrated in FIG. 2.

$$e_0 - e_1 = R \times i_{01} \tag{3-1}$$

$$e_0 - e_2 = R \times i_{02} \tag{3-2}$$

$$e_0 - e_3 = R \times i_{03} \tag{3-3}$$

$$e_0 - e_4 = R \times i_{04} \tag{3-4}$$

$$e_1 + e_2 + e_3 + e_4 - 4e_0 = -R(i_{01} + i_{02} + i_{03} + i_{04}) = 0 \tag{4-1}$$

-continued $$\frac{\partial^2 e}{\partial x^2}+\frac{\partial^2 e}{\partial y^2} = e_1+e_2+e_3+e_4-4e_0 \quad (4\text{-}2)$$
$$= 0$$

Therefore, it will be understood by those skilled in the art that FIG. 2 shows a resistor network representing the Laplace's equation.

It should be noted that Equation (4-2) has nothing corresponding to $\Delta^2$ of a denominator on the right side in Equation (2-1). This is because resistance R in the resistor network corresponds to the space $\Delta$ in the coordinate system in FIG. 1, so that $\Delta$ is not necessary in the electric voltage function.

Figure 3:
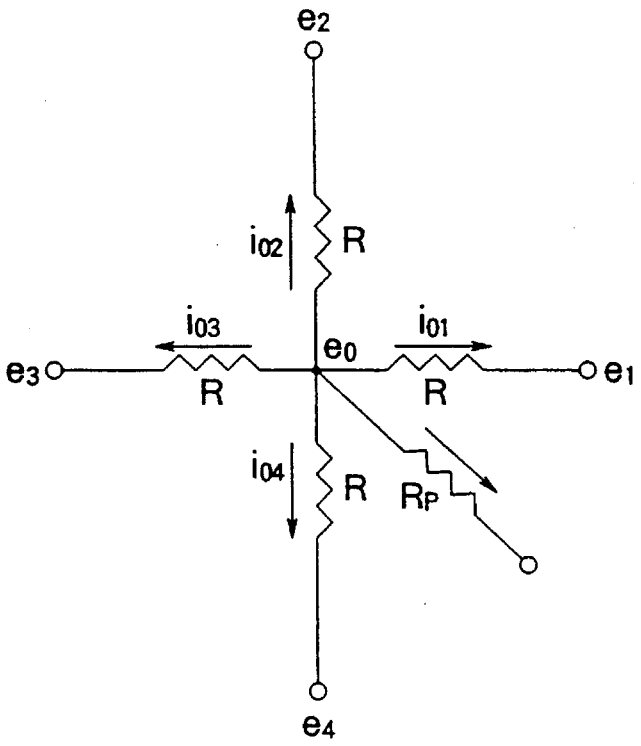
FIG. 3 PRIOR ART
FIG. 3 is a view for describing a unit element of another conventional resistor network to solve the Poisson's equation in accordance with the analog solution.

FIG. 3 shows a unit element comprising an additional resistor connected to a node of four resistors of the resistor network of FIG. 2. Denoting the voltages and the currents as illustrated in the figure, Equation (5-1) is given in connection with the currents by the Kirchhoff's current law. Equation (5-1) is transformed into Equation (5-2) related to the voltages, taking into consideration resistors R and voltages $e_0$–$e_4$ and $e_\alpha$ at nodes. The left side of Equation (5-2) is the same of the right side of Equation (4-2). Let a voltage difference ($e_0$–$e_\alpha$) across the additional resistor $R_p$ be represented by $\alpha$. In this event, Equation (5-2) is rewritten into Equation (6-1). Replacing the voltage function e by the continuous function $\phi$, Equation (6-2) representing the Poisson's equation is given. The resistor network illustrated in FIG. 3 electrically satisfies the Poisson's equation.

$$i_{01}+i_{02}+i_{03}+i_{04}=-i_{0\alpha} \quad (5\text{-}1)$$

$$e_1+e_2+e_3+e_4-4e_0=e_0-e_\alpha \quad (5\text{-}2)$$

$$\frac{\partial^2 e}{\partial x^2}+\frac{\partial^2 e}{\partial y^2}=\alpha \quad (6\text{-}1)$$

$$\frac{\partial^2 \phi}{\partial x^2}+\frac{\partial^2 \phi}{\partial y^2}=\alpha \quad (6\text{-}2)$$

Figure 4:
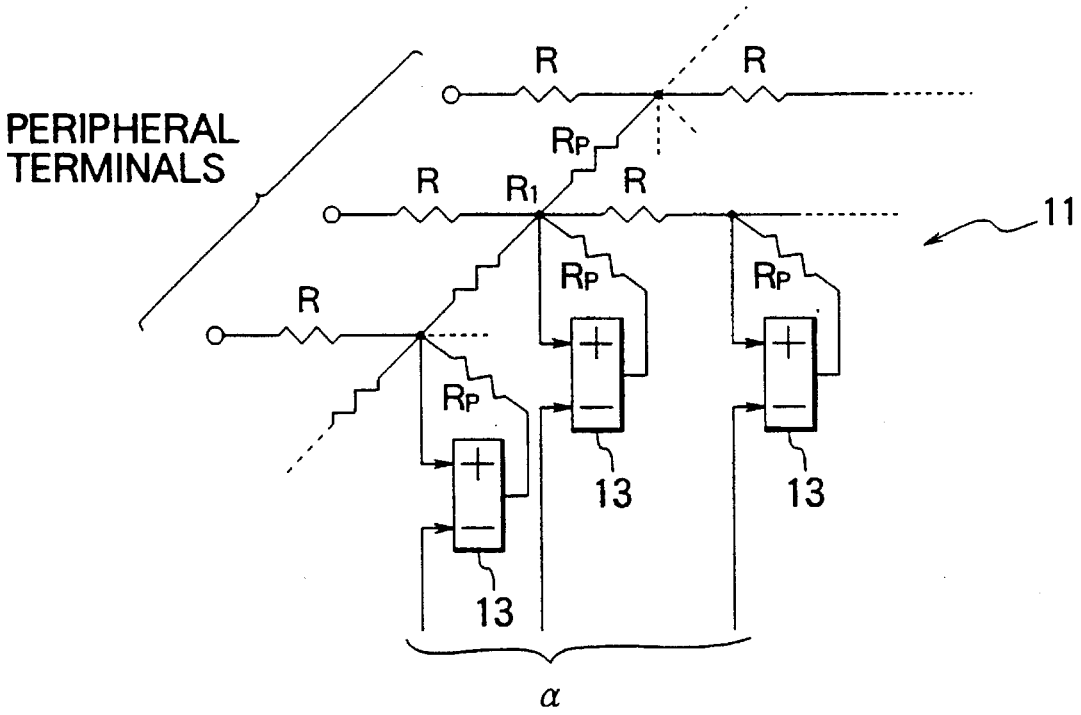
FIG. 4 PRIOR ART
FIG. 4 is a view for describing an actual resistor network using the unit elements of FIG. 3 with subtracter circuits.

Referring to FIG. 4, description will be made as regards an actual circuit using the unit element of FIG. 3 to solve the above-mentioned Poisson's equation. A resistor network 11 comprises a plurality of unit elements of FIG. 3 which are continuously formed to arrange nodes in a matrix form. A plurality of subtractor circuits 13 are connected to the nodes, respectively, as shown in the figure. Each of the subtractor circuits 13 has a negative input terminal supplied with a voltage corresponding to $\alpha$ at the right side of Equation (6). In addition, a peripheral voltage is supplied to each of peripheral terminals of the resistor network. The peripheral voltage is given as a calculation result by an analysis condition of the calculus of finite difference. As a result, distribution of voltages at the nodes such as $P_1$ of the resistor network is obtained as distribution of solutions of the continuous function $\phi$ in Equation (6-2).

Next, description proceeds to a structure of a main portion of a circuit for solving a fourth-order partial differential equation according to an embodiment of this invention. The fourth-order partial differential equation in Equation (7) can be transformed into simultaneous equations of the Poisson's equation and the Laplace's equation (Equations (8-1) and (8-2)). Accordingly, when the above-mentioned two circuits are electrically cooperatively coupled, it will be noted that a circuit can be made for solving the fourth-order partial differential equation.

$$\frac{\partial^4 \phi}{\partial x^4}+\frac{\partial^4 \phi}{\partial x^2 \partial y^2}+\frac{\partial^4 \phi}{\partial y^4}=0 \quad (7)$$

-continued $$\frac{\partial^2 \phi}{\partial x^2}+\frac{\partial^2 \phi}{\partial y^2}=\alpha \quad (8\text{-}1)$$

$$\frac{\partial^2 \alpha}{\partial x^2}+\frac{\partial^2 \alpha}{\partial y^2}=0 \quad (8\text{-}2)$$

Figure 5:
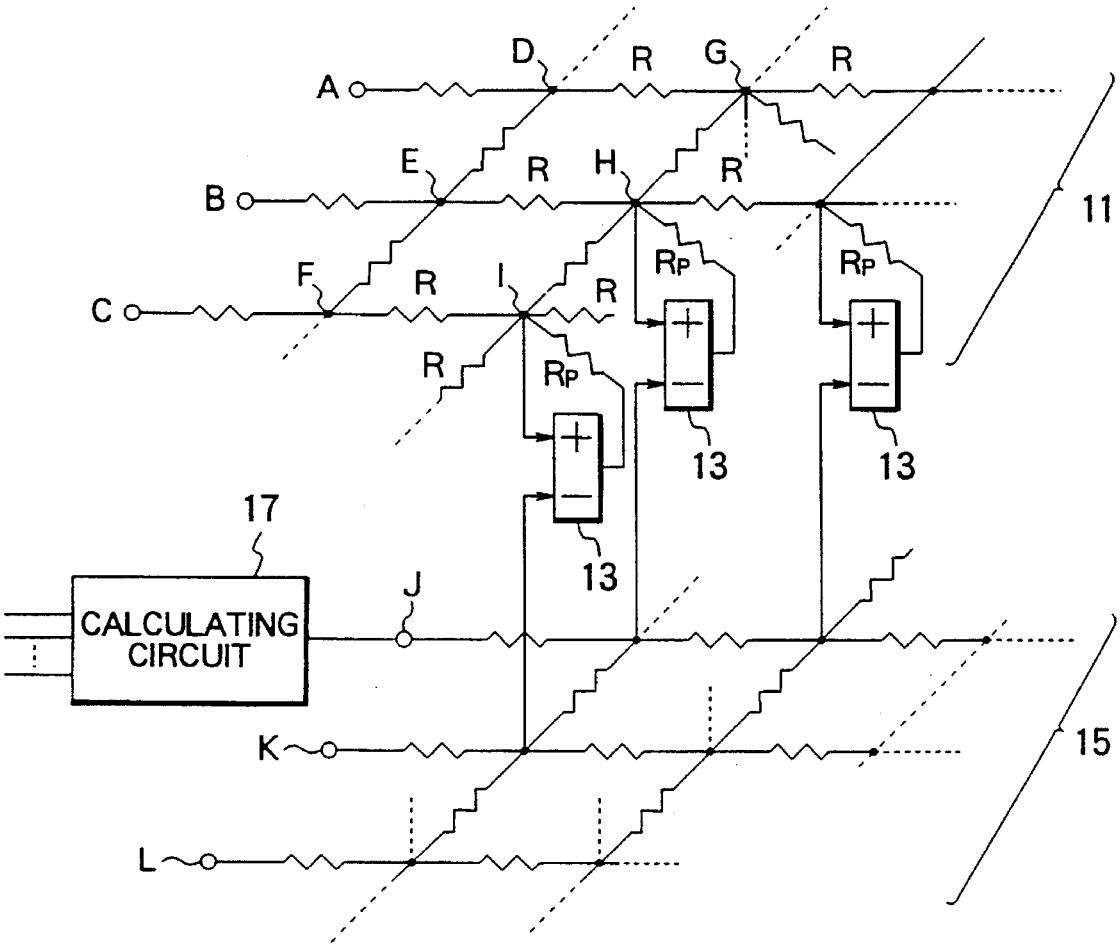
FIG. 5 is a view for describing a resistor network to solve a fourth-order partial differential equation according to an embodiment of this invention.

FIG. 5 shows a part of the circuit for solving the fourth-order partial differential equation of the function $\phi$. A first resistor network 11 is a circuit of FIG. 4 for solving the Poisson's equation. A second resistor network 15 is a circuit of FIG. 2 for solving the Laplace's equation. A plurality of subtractor circuits 13 correspond to those in FIG. 4. Each of the subtractor circuits 13 is for supplying solutions $\alpha$ of Equation (8-2) distributed at second nodes on the second resistor network 15 to the corresponding first nodes on the first resistor network 11 for solving Equation (8-1). Each of the subtractor circuits 13 has a negative input terminal connected to each one of the second nodes of the second resistor network 15, a positive input terminal connected to the corresponding one of the first nodes of the first resistor network 11, and an output terminal connected to the corresponding one of additional resistors R of the first resistor network 11.

Referring to FIG. 5, the first resistor network 11 is provided with peripheral terminals shown at, for example, A, B, and C, which are supplied with external point voltages $V_A$, $V_B$, and $V_C$, respectively. The outermost nodes of the first resistor network 11, shown at, for example, D, E, and F are supplied with boundary voltages $V_D$, $V_E$, and $V_F$, respectively. The other nodes of the first resistor network 11 shown by, for example, G, H, and I have voltages $V_G$, $V_H$, and $V_I$ as solutions obtained by the circuit. The second resistor network 15 is provided with peripheral terminals shown at, for example, J, K, and L which are supplied with boundary voltages $V_J$, $V_K$, and $V_L$. A calculating circuit 17 carries out a calculation represented by ($V_B$+$V_F$+$V_H$+$V_D$–4×$V_E$) with respect to those voltages on the first resistor network 11. The calculating circuit 17 has an output terminal connected to the terminal J. A plurality of like calculating circuits similar to the calculating circuit 17 are arranged to be connected to all peripheral terminals, respectively, of the second resistor network 15, although only one is shown in the figure.

Generally speaking, each of the calculating circuits calculates a total voltage of one ($V_B$) of the external point voltages ($V_A$, $V_B$, $V_C$, . . . ) supplied to corresponding one (B) of the peripheral terminals (A, B, C, . . . ), two ($V_D$, $V_F$) of the boundary voltages ($V_D$, $V_E$, $V_F$, . . . ) supplied to two (D, F) adjacent to the corresponding one (E) of the outermost nodes (D, E, F, . . . ), and one ($V_H$) of the node voltages ($V_G$, $V_H$, $V_I$, . . . ) on the adjacent one (H) of the inner nodes adjacent to the corresponding one (E) of the outermost nodes (D, E, F, . . . ). The subtracting circuit further subtracts four times of one ($V_E$) of the boundary voltages ($V_D$, $V_E$, $V_F$, . . . ) supplied to the corresponding one (E) of the outermost nodes (D, E, F, . . . ) from the total voltage to produce a calculated voltage ($V_B$+$V_F$+$V_H$+$V_D$–4×$V_E$). The calculated voltage is supplied to the corresponding one (K) of the external terminals (J, K, L, . . . ) of the Laplace's circuit 15. Thus, node voltages on the Poisson's circuit 11 provide solutions of the function of the fourth-order partial differential equation.

Those voltages applied to the outermost nodes D, E, and F of the circuit and to the peripheral terminals A, B, and C of the first resistor network 11 are calculated under an analysis condition by the calculus of finite difference. Supplied with those voltages, the solutions are obtained in the form of the voltages distributed at the first nodes of the first resistor network 11.

In order to confirm the performance of the solution network and the method according to this invention, a test was carried out for the circuit to solve the fourth-order partial differential equation as regards an exercise of a stress distribution analysis. A comparison was made between a calculation result obtained by the calculus of finite difference as disclosed in a literature entitled "Theory of Elasticity" (Third Edition) written by Timoshenko et al, pp. 538–544, McGRAW-HILL INTERNATIONAL EDITIONS and a result obtained by the resistor networks according to this invention.

A two-dimensional condition of a stress in an elastic body is defined by a stress function $\phi$ which, under the boundary conditions represented by Equations (9-1) and (9-2), satisfies a relationship similar to Equation (7) already described.

$$\frac{\partial^2\phi}{\partial y^2}\cos\beta-\frac{\partial^2\phi}{\partial x\partial y}\sin\beta=F_x \tag{9-1}$$

$$\frac{\partial^2\phi}{\partial x^2}\sin\beta-\frac{\partial^2\phi}{\partial x\partial y}\cos\beta=F_y \tag{9-2}$$

In Equations (9-1) and (9-2), $F_x$ and $F_y$ represent external forces on a boundary surface and $\beta$ represents an angle formed between the x axis and the boundary surface. The relationship of the stress function $\phi$, which is a function of x and y, stress components $\sigma_x$ and $\sigma_y$, and a shearing stress $\tau_{xy}$ is represented by Equations (10).

$$\sigma_x=\frac{\partial^2\phi}{\partial y^2},\ \sigma_y=\frac{\partial^2\phi}{\partial x^2},\ \tau_{xy}=-\frac{\partial^2\phi}{\partial x\partial y} \tag{10}$$

Figure 6:
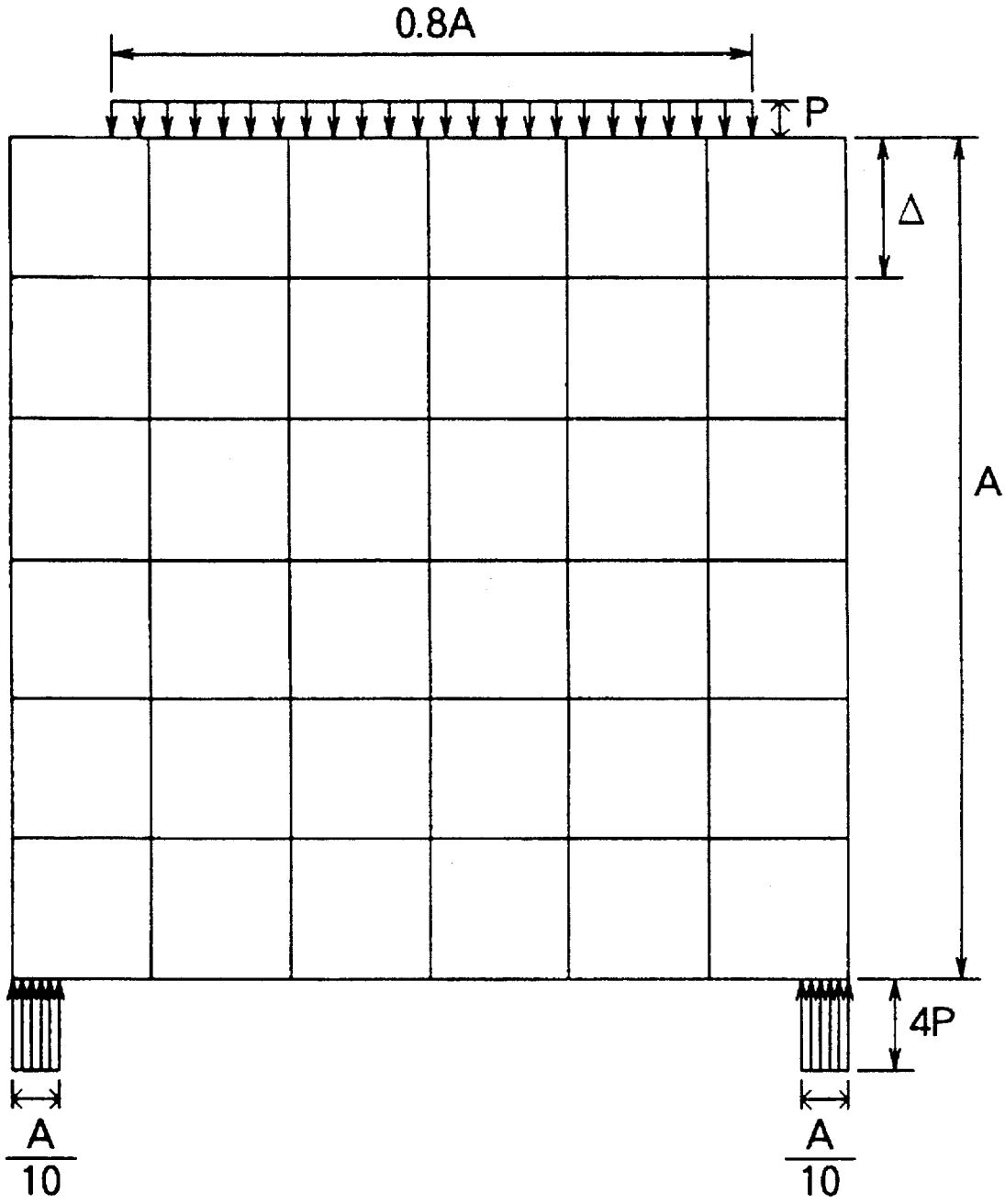
FIG. 6 shows a structure of a simulation model prepared for comparison between an analytical result obtained by the resistor network according to this invention and an analytical result calculated by the finite difference method.

FIG. 6 shows a simulation model according to the disclosure in the above-mentioned literature. Referring to FIG. 6, a square elastic body of dimensions A×A is segmented into small square sections, six by six. As boundary conditions, the elastic body is applied with an external force P onto a part (0.8A) of a top area that occupies 80% of the top area. The elastic body is also applied with an external force 4P onto a part (0.2A) of a bottom area that occupies 20% of the bottom area but the part is shared at both sides thereof. Table 1 shows a stress distribution containing values at the boundary points and at the external points as well as internal stresses calculated. In Table 1, a region of the calculated values is shown to be surrounded by an inner thick line. Outside of the calculated region, the boundary conditions are shown in another region surrounded by an outer thick line. Outside of the boundary conditions, the external points are shown.

An apparatus actually used in the test was formed according to the circuit network of FIG. 5, so that it comprises a main circuit network or a first resistor network comprising a plurality (6×6) of electric resistor elements (having a resistance of 500 Ω and an accuracy of 0.1%) connected to one another through first nodes of (5×5) to form a lattice structure, and like additional resistors connected to the first nodes, respectively. The main circuit network corresponds to the circuit for the Poisson's equation shown in FIG. 4. The apparatus further comprises a subsidiary circuit network or a second resistor network having a similar structure but without any additional resistor. The subsidiary circuit network corresponds to the circuit for the Laplace's equation of FIG. 2. The apparatus still further comprises a plurality of subtractor circuits (13 in FIG. 5) each of which is for connecting each of the first nodes and each of the second nodes of the main and the subsidiary circuit networks at the same coordinate position. The apparatus further comprises calculating circuits (17 in FIG. 5) for calculating voltages at boundary points, external points, and internal points of the main circuit network and for supplying those voltages as peripheral voltages to peripheral terminals of the subsidiary circuit network. Both of the subtractor circuits and the calculating circuits are driven by a direct current source of ±15 volts.

The numerical values in Table 1 corresponding to the external points and the boundary points were converted into voltages (represented by volt in unit) to be applied to the main circuit network as boundary conditions. Then, resultant voltages at nodes distributed over the main and the subsidiary circuit networks of this apparatus were measured. Table 2 shows a voltage distribution measured on the main circuit network. Like Table 1, Table 2 includes a measured region which is shown to be surrounded by the inner thick line and contains measured values at internal nodes. The voltage distribution shown is noted to correspond to the internal stress function $\phi$. The boundary condition setting region is also shown to be surrounded by the outer thick line. Outside of the boundary condition setting region, the external points are shown. The external points are used to calculate boundary voltages of the subsidiary circuit network. The external points are not directly involved in calculation of the internal stress.

TABLE 1

| | | | | | | | | |
|---|---|---|---|---|---|---|---|---|
| | | 1.4820 | 2.8850 | 3.3560 | 2.8850 | 1.4820 | | |
| | −0.7200 | 1.6000 | 3.1000 | 3.6000 | 3.1000 | 1.6000 | −0.7200 | |
| −3.3180 | −0.7200 | 1.4820 | 2.8850 | 3.3560 | 2.8850 | 1.4820 | −0.7200 | −3.3180 |
| −3.4890 | −0.7200 | 1.3110 | 2.5120 | 2.9060 | 2.5120 | 1.3110 | −0.7200 | −3.4890 |
| −3.7030 | −0.7200 | 1.0970 | 2.0240 | 2.3060 | 2.0240 | 1.0970 | −0.7200 | −3.7030 |
| −4.0000 | −0.7200 | 0.8000 | 1.3810 | 1.5310 | 1.3810 | 0.8000 | −0.7200 | −4.0000 |
| −4.4040 | −0.7200 | 0.3960 | 0.6080 | 0.6340 | 0.6080 | 0.3960 | −0.7200 | −4.4040 |
| | −0.7200 | 0.0000 | 0.0000 | 0.0000 | 0.0000 | 0.0000 | −0.7200 | |
| | | 0.3960 | 0.6080 | 0.6340 | 0.6080 | 0.3960 | | |

TABLE 2

| | | | | | | | | |
|---|---|---|---|---|---|---|---|---|
| | | 1.4796 | 2.8851 | 3.3560 | 2.8843 | 1.4804 | | |
| | −0.7196 | 1.6003 | 3.1017 | 3.6009 | 3.1016 | 1.6003 | −0.7196 | |
| −3.3204 | −0.7196 | 1.4796 | 2.8851 | 3.3560 | 2.8843 | 1.4804 | −0.7196 | −3.3196 |
| −3.4922 | −0.7196 | 1.3078 | 2.5126 | 2.9061 | 2.5118 | 1.3078 | −0.7196 | −3.4922 |
| −3.7066 | −0.7196 | 1.0934 | 2.0229 | 2.3047 | 2.0224 | 1.0935 | −0.7196 | −3.7065 |
| −4.0033 | −0.7196 | 0.7967 | 1.3796 | 1.5284 | 1.3798 | 0.7970 | −0.7196 | −4.0030 |
| −4.4084 | −0.7196 | 0.3916 | 0.6027 | 0.6313 | 0.6029 | 0.3917 | −0.7195 | −4.4083 |
| | −0.7196 | 0.0000 | 0.0000 | 0.0000 | 0.0000 | 0.0000 | −0.7196 | |
| | | 0.3916 | 0.6027 | 0.6313 | 0.6029 | 0.3917 | | |

Table 3 shows a voltage distribution on the subsidiary circuit network. In Table 3 also, a measured region is shown to be surrounded by a thick line. In the measured region, the resultant voltage distribution is an output voltage corresponding to $\alpha$ at the right side of Equation (8-1). Equation (10) is substituted for the left side of Equation (8-1). The resultant voltage distribution corresponds to a total main stress ($\sigma_x+\sigma_y$) of the internal stress. Outside of the thick line, the boundary voltages given by the main circuit network are shown. When the resultant voltage has a negative polarity, the stress is understood to be compression. On the other hand, when the resultant voltage has a positive polarity, the stress is tension.

TABLE 3

| | | | | | | |
|---|---|---|---|---|---|---|
| | −1.0656 | −1.4608 | −1.5006 | −1.4533 | −1.0769 | |
| −0.3930 | −0.8579 | −1.1022 | −1.1605 | −1.0998 | −0.8574 | −0.3823 |
| −0.7286 | −0.8715 | −0.9289 | −0.9393 | −0.9279 | −0.8710 | −0.7296 |
| −1.1628 | −0.9707 | −0.8023 | −0.7403 | −0.8016 | −0.9690 | −1.1581 |
| −1.7533 | −1.0460 | −0.5694 | −0.4183 | −0.5694 | −1.0458 | −1.7546 |
| −2.5689 | −0.8902 | −0.0113 | −0.2064 | −0.0112 | −0.8906 | −2.5713 |
| | 0.0653 | 1.2079 | 1.2660 | 1.2083 | 0.0650 | |

For comparison between the test result and the calculation result, the values in Table 3 are subtracted from the values of Table 1 at the corresponding coordinate positions, respectively, to obtain differences between them as errors. Table 4 shows an error map thus obtained. It is understood from Table 4 that the maximum error is equal to 0.005. Thus, within an error range of the apparatus, the calculated values and the test results are well coincident with each other. Accordingly, it is confirmed that the apparatus of the present invention has an excellent performance. By the use of the values in Table 2, when Equations (1-3), (1-4), and (1-5) are calculated with reference to the coordinate system in FIG. 1, the vertical stress $\sigma_y$, the horizontal stress $\sigma_x$, and the shearing stress $\tau_{xy}$ are calculated in accordance with Equation (10).

TABLE 4

| | | | | |
|---|---|---|---|---|
| 0.002 | −0.000 | 0.000 | 0.001 | 0.002 |
| 0.003 | −0.001 | −0.000 | 0.000 | 0.003 |
| 0.004 | 0.001 | 0.001 | 0.002 | 0.004 |
| 0.003 | 0.001 | 0.003 | 0.001 | 0.003 |
| 0.004 | 0.005 | 0.003 | 0.005 | 0.004 |

As described above, the additional resistor is connected at its one end to each node of the resistor network comprising the resistors connected to one another through the nodes to form a lattice structure. Then, the predetermined voltage is subtracted from the node voltage at each node to produce the subtractor output. The subtractor output is supplied to the other end of the additional resistor connected to each node. The peripheral voltage is applied to the peripheral terminals of the resistor network. Another resistor network comprising similar resistors connected to one another to form a lattice structure is added thereto. Thus, the fourth-order partial differential equation is electrically solved in an analog fashion.

In the foregoing embodiment, description is directed to an application on the stress distribution function. However, this invention is not restricted to the above-mentioned embodiment but is applicable to any simulation inasmuch as it is related to the fourth-order partial differential equation.

What is claimed is:

1. An analog arithmetic circuit for solving a fourth-order partial differential equation of a function comprising:

a first resistor network comprising a plurality of first resistors connected to each other in a form of a lattice structure to have a plurality of first interconnected points arranged in a matrix form and a plurality of additional resistors having one ends connected to said first interconnected points, respectively, said first resistor network having a plurality of first peripheral terminals at outer ends of outermost ones of said first resistors, said first peripheral terminals being supplied with external point voltages of first predetermined voltage levels, respectively, outermost ones of said first interconnected points being supplied with boundary voltages of second predetermined voltage levels, first resultant voltages being present at the remaining ones of said first interconnected points excluding said outermost first interconnected points;

a plurality of subtracting means connected to said remaining first interconnected points, respectively, for subtracting second resultant voltages from said first resultant voltages to produce subtracted voltages, said subtracted voltages being supplied to the other ends of said additional resistors, respectively;

a second resistor network comprising a plurality of second resistors connected to each other in a form of a lattice structure to have a plurality of second interconnected points arranged in a matrix form and corresponding to said remaining first interconnected points, respectively, said second resistor network having a plurality of second peripheral terminals at outer ends of outermost ones of said second resistors, said second peripheral terminals corresponding to said first peripheral terminals, respectively, said second resultant voltages being present at said second interconnected points and being supplied therefrom to said subtracting means, respectively; and a plurality of calculating means connected to said second peripheral terminals, respectively, each of said calculating means calculating a total voltage of one of said external point voltages supplied to a corresponding one of said first peripheral terminals, two of said boundary voltages supplied to two adjacent to the corresponding one of said outermost first interconnected points, and one of said first resultant voltages on the adjacent one of said remaining ones of said first interconnected points adjacent to said corresponding one of said outermost first interconnected points, and subtracting four times of one of said boundary voltages supplied to said corresponding one of said outermost first interconnected points from said total voltage to produce a calculated voltage, said calculated voltage being supplied to the corresponding one of said second external terminals, whereby said first resultant voltages provide solutions of said function of said fourth-order partial differential equation.

2. An analog operation circuit for solving a fourth-order partial differential equation as claimed in claim 1, wherein said first and said second resistors have an equal resistance.

3. An analog operation circuit for solving a fourth-order partial differential equation as claimed in claim 2, wherein said external point voltages and boundary voltages have values converted from boundary conditions of the differential equation.

4. An analog operation circuit for solving a fourth-order partial differential equation as claimed in claim 3, wherein said fourth-order partial differential equation is one describing a two-dimensional condition of a stress in an elastic body, said second resultant voltages on said second interconnecting points corresponding to a total main stress.

5. A method of solving a fourth-order partial differential equation of a function by the use of an analog arithmetic circuit comprising:

a first resistor network comprising a plurality of first resistors connected to each other in a form of a lattice structure to have a plurality of first interconnected points arranged in a matrix form and a plurality of additional resistors having one ends connected to said first interconnected points, respectively, said first resistor network having a plurality of first peripheral terminals at outer ends of outermost ones of said first resistors, said first interconnected points classified into outermost ones and the remaining ones;

a plurality of subtracting means having first input terminals connected to said remaining first interconnected points, respectively, second input terminals, and output terminals connected to the other ends of said additional resistors, respectively;

a second resistor network comprising a plurality of second resistors connected to each other in a form of a lattice structure to have a plurality of second interconnected points arranged in a matrix form and corresponding to said remaining first interconnected points, respectively, said second resistor network having a plurality of second peripheral terminals at outer ends of outermost ones of said second resistors, said second peripheral terminals corresponding to said first peripheral terminals, respectively, said second interconnected points being connected to said second input terminals of said subtracting means, respectively;

a plurality of calculating means connected to said second peripheral terminals, respectively;

said method comprising the steps of:

supplying external voltages of first predetermined voltage levels to said first terminals and said calculating means, respectively, first resultant voltages being present at said remaining first interconnected points;

supplying boundary voltages of second predetermined voltage levels to said outermost first interconnected points and said calculating points, each of said calculating means calculating a total voltage of one of said external point voltages supplied to a corresponding one of said first peripheral terminals, two of said boundary voltages supplied to two adjacent to the corresponding one of said outermost first interconnected points, and one of said first resultant voltages on the adjacent one of said remaining ones of said first interconnected points adjacent to said corresponding one of said outermost first interconnected points, and subtracting four times of one of said boundary voltages supplied to said corresponding one of said outermost first interconnected points from said total voltage to produce a calculated voltage, said calculated voltage being supplied to the corresponding one of said second external terminals, whereby second resultant voltages are present at said second interconnected points, said subtracting means subtracting said second resultant voltages from said first resultant voltages to produce subtracted voltages, said subtracted voltages being supplied to said other ends of said additional resistors, so that said first resultant voltages provide solutions of said function of said fourth-order partial differential equation.

6. A method of solving a fourth-order partial differential equation of a function by the use of an analog arithmetic circuit as claimed in claim 5, wherein said first and said second resistors have an equal resistance.

7. A method of solving a fourth-order partial differential equation of a function by the use of an analog arithmetic circuit as claimed in claim 6, wherein said external point voltages and boundary voltages have values converted from boundary conditions of the differential equation.

8. A method of solving a fourth-order partial differential equation of a function by the use of an analog arithmetic circuit as claimed in claim 7, wherein said fourth-order partial differential equation is one describing a two-dimensional condition of a stress in an elastic body, said second resultant voltages on said second interconnecting points corresponding to a total main stress.

* * * * *